United States Patent [19]

Dresen et al.

[11] 4,428,306

[45] Jan. 31, 1984

[54] PALLET

[75] Inventors: William L. Dresen, Baraboo, Wis.; William F. Price, Taylor Ridge, Ill.; Harlan W. Breezer, Portage, Wis.

[73] Assignee: Penda Corporation, Portage, Wis.

[21] Appl. No.: 310,052

[22] Filed: Oct. 9, 1981

[51] Int. Cl.[3] ..... B65D 19/32

[52] U.S. Cl. ..... 108/53.3; 108/901

[58] Field of Search ..... 108/53.3, 53.1, 51.1, 108/901, 57.1, 55.1–55.3, 56.1, 56.3; 206/386, 599

[56] References Cited

U.S. PATENT DOCUMENTS

| | | | |
|---|---|---|---|
| 3,467,032 | 9/1969 | Rowlands et al. | 108/901 X |
| 3,524,415 | 8/1970 | Heiman | 108/53.3 |
| 3,610,173 | 10/1971 | McIlwraith et al. | 108/56.1 |
| 3,707,127 | 12/1972 | Palfey et al. | 108/53.3 |
| 3,719,157 | 3/1973 | Arcocha et al. | 108/901 X |
| 3,750,596 | 8/1973 | Box | 108/53.1 |
| 3,776,145 | 12/1973 | Anderson et al. | 108/51.1 |
| 4,015,544 | 4/1977 | Szatkowski | 108/51.3 |
| 4,290,369 | 9/1981 | Propst et al. | 108/56.3 X |

FOREIGN PATENT DOCUMENTS

| | | | |
|---|---|---|---|
| 2535681 | 2/1977 | Fed. Rep. of Germany | 108/55.1 |
| 2651929 | 5/1978 | Fed. Rep. of Germany | 108/55.1 |

*Primary Examiner*—William E. Lyddane

*Attorney, Agent, or Firm*—Isaksen, Lathrop, Esch, Hart & Clark

[57] ABSTRACT

A pallet (10) is disclosed which is particularly adapted for being constructed of moldable thermoplastic materials. The pallet includes a load-bearing surface (12) supported by a plurality of feet (32) with the load-bearing surface (12) being constructed of a pair of sheets of the thermoplastic material (13, 15) located in spaced parallel relationship to each other. Respective top (22, 24) and bottom (26) channels are formed in the upper and lower sheets of material (13, 15) with the bottoms of each of the channels (22, 24, 26) being joined to the bottom of the channels from the other sheet of material to securely and rigidly fix the two sheets of material (13, 15) together. The feet (32) include alternating solid (40) and hollow (38) portions which serve to make the feet (32) extremely strong. An alternative embodiment of the present invention includes a self-draining feature so that the channels (122) on the top surface of the pallet drain into the feet (132) with the fluid entering the feet (132), draining from a hole (143) provided in the bottoms thereof.

17 Claims, 9 Drawing Figures

PALLET

TECHNICAL FIELD

The present invention relates to pallets in general and, in particular, to pallets which can be constructed of thermoplastic materials formed by thermoforming methods.

DESCRIPTION OF THE PRIOR ART

The prior art is generally cognizant of the general concept and desirability of manufacturing pallets from moldable materials such as thermoplastic resins. Among the kinds of prior art pallets which were known is one general variety constructed of a single planar member of plastic material which serves as a load-bearing member, with feet formed to elevate the single layer of material. Examples of pallets of this general character can be found in U.S. Pat. Nos. 3,140,672, 3,640,299, 3,680,495, and 3,720,176. Of these patents, U.S. Pat. No. 3,140,672 discloses a molded pallet which includes a planar deck 11 having a plurality of ribs 15 provided in it to stiffen and reinforce it. Another method utilized in the prior art to construct pallets of moldable material has been to construct two substantially planar load-bearing members which are positioned in parallel to each other and spaced by reinforcing or stiffening members spaced so as to allow the projection of the arms of a forklift therethrough. Examples of pallets formed of this general character can be seen in U.S. Pat. Nos. 3,404,642, 3,680,496, 3,691,964, 3,699,902, and 3,757,704. Other examples of patents disclosing pallet configurations which can be constructed of molded materials can be seen in U.S. Pat. Nos. 3,561,375, 3,697,029, 3,717,922, and 3,719,157.

SUMMARY OF THE INVENTION

The present invention is summarized in that a pallet includes: a substantially planar load-bearing member formed from an upper sheet of material and a lower sheet of material located in spaced parallel relationship to each other; means for elevating the load-bearing member a selected distance above the surface on which the pallet is resting; the upper sheet of material having defined in its upper surface a plurality of linearly extending, upwardly opening top channels having a depth approximately equal to one half the distance between the upper and lower sheets of material, the top channels having floor portions; the lower sheet of material having defined therein a plurality of linearly downwardly opening channels having a depth approximately equal to the depth of the top channels, the bottom channels' ceiling portions formed at the top thereof, the top channels and the bottom channels being so oriented relaative to each other that at no point is any one of the top channels parallel to an adjacent one of the bottom channels and so that where each of the top channels intersects a one of the bottom channels, the floor portion of the top channel is integrally attached to the ceiling portion of the adjacent bottom channel.

It is an object of the present invention to construct a pallet formed of moldable thermoplastic material which is inherently stronger and more resistant to buckling and folding than previously known pallets constructed of such materials.

It is another object of the present invention to provide such a pallet in which the legs elevating the load-bearing member of the pallet off of the surface have a particularly high compressive strength so that the pallet has a large capacity.

It is yet another object of the present invention to provide such a pallet having a non-stick surface so that objects do not tend to slip off the pallet is tilted at a slight angle.

It is yet another object of the present invention to provide such a pallet that includes all of the above features and yet is also capable of being nested so that the pallets can be stacked when empty in as small an area as possible.

It is a feature of the present invention in that the pallet constructed so as to have all of these features is readily manufacturable efficiently and economically from thermoplastic materials with a minimum of manufacturing steps and expense.

Other objects, features, and advantages of the present invention will become apparent from the following specification when read in conjunction with the accompanying drawings.

PREFERRED EMBODIMENT OF THE PRESENT INVENTION

Figure 1:
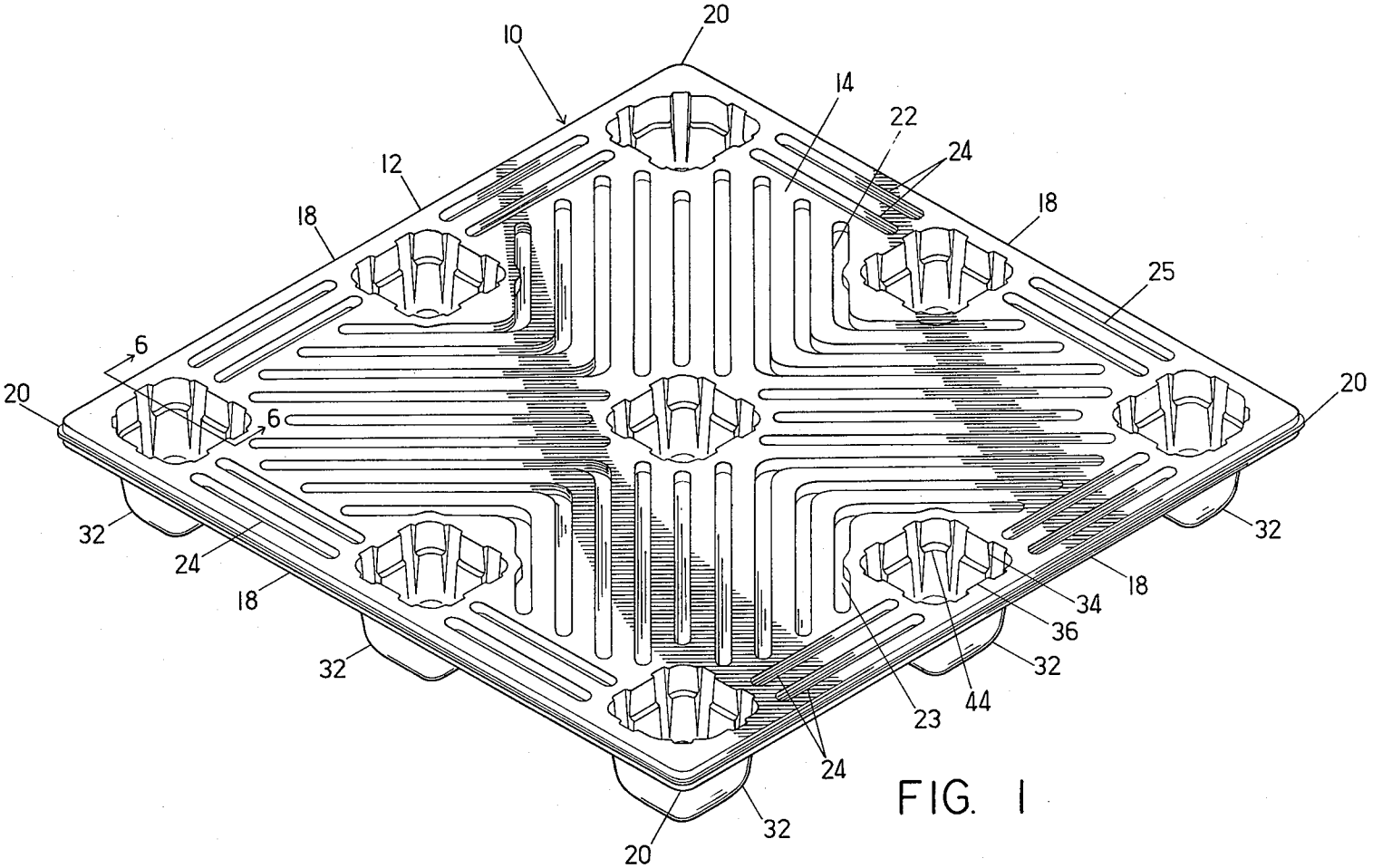
FIG. 1 is a perspective view of the pallet constructed in accordance with the present invention.

Shown in FIG. 1, and generally illustrated at 10, is a pallet constructed in accordance with the present invention. The pallet 10 is particularly adapted to be constructed of molded material, such as a suitable thermoplastic material, as will be described in more detail later. The pallet 10 includes a substantially planar load-bearing member 12 of a suitable constant thickness. The load-bearing member 12 itself is formed of two separate sheets of material, an upper sheet 13 and a lower sheet 15. The two sheets of material 13 and 15 are largely positioned parallely to each other separated by the width of the load-bearing member 12 itself. In the illustration of FIGS. 1 through 7, the upper surface of the upper sheet of material 13 is designated by the numeral 14, while the lower sheet of material 15 is designated by the numeral 16. As can be seen readily by referring to FIG. 1, the load-bearing member 12 is substantially rectangular and has four similar quarters, each of which is defined by a pair of lines extending outwardly from the center of the pallet 10 to bisect the sides of the rectangle of the load-bearing member 12. The load-bearing member 12 has formed at its outer edge a peripheral lip 18 which is formed by the edges of the upper sheet of material 13 and the lower sheet of material 15 being joined together around the periphery of the load-bearing member 12 at a point halfway between the two sheets of material. Being rectangular, the load-bearing member 12 has four corners, each of which is designated by the numeral 20 in FIG. 1.

Formed on the interior of the upper surface 14 of the upper sheet of material 13 are a plurality of linearly extending top channels 22. The channels 22 have a depth approximately equal to one half of the thickness of the load-bearing member 12 and along their bottom surfaces each of the channels 22 has a floor portion 23, the floor portions 23 of each of the channels 22 being generally horizontal and parallel to the top surface 14 of the upper sheet of material 13 itself. As can be seen by referring to FIG. 4, in each of the quarters of the load-bearing surface 12, the top channels 22 formed in the interior of the upper sheet of material 13 are oriented so that they are all parallel to a line drawn from a center of that quarter to the corner 20 located in that quarter of the load-bearing member 12. As can also be seen in FIG. 4, the interior top channels 22 are equally spaced from each other and are evenly distributed across the width of the quarter of the load-bearing member 12. Within the quarter of the load-bearing member 12 shown in FIG. 4, there are also formed two pairs of border channels 24 which are formed extending along the borders of the upper sheet of material 13 adjacent and parallel to the peripheral lip 18. The border channels 24 are similar in rectangular cross-sectional shape and size to the size and spacing of the interior top channels 22 formed in the remaining portion of the upper sheet 13. The border channels 24 also have floor portions 25 which are formed along the bottoms thereof.

The lower sheet of material 15 also has a plurality of channels, designated by the reference numeral 26 formed in the lower surface 16 of the lower sheet of material 15. The bottom channels 26 formed in the lower sheet of material 15 are similar in size, shape and spacing to the top channels 22, and also have a depth approximating one half the thickness of the load-bearing member 12. The bottom channels 26 terminate in ceiling portions 30 formed at the top thereof. Similarly to the top channels 22 and 24, the ceiling portions 30 of the bottom channels 26 are planar and horizontal in character and parallel to the lower surface 16 of the lower sheet of material 15. The orientation of the bottom channels 26 can best be viewed in FIG. 2, and in that figure it can be seen that the bottom channels 26 tend to run parallel to each other and that in each quarter of the load-bearing member 12, the bottom channels 16 are oriented perpendicular to a line drawn from the center of the load-bearing member 12 to the adjacent outside corner 20. Thus, as can be ascertained from FIG. 4, which shows both the top channels 22 in solid lines and the bottom channels 26 in dashed lines, within each quarter of the load-bearing member 12 the top channels 22 and the bottom channels 26 run substantially at right angles to each other. Furthermore, even though the top border channels 24 are not parallel to the interior top channels 22 formed in the upper sheet of material 13, the border channels 24 are oriented in such a fashion that they intersect the position of the bottom channels 26 at an angle of approximately 45 degrees. Thus it can be seen that the top channels 22 and 24 and the bottom channels 26 have frequent intersections in which they are adjacent to each other, but, at no point along the load-bearing member 12 do they run parallel to each other. At each of the points at which a one of the top channels 22 or 24 intersects a one of the bottom channels 26, the respective floor portions 23 or 25 of the top channels 22 and 24 are integrally joined to the ceiling portion 30 of the adjacent bottom channel 26 at that intersection. This joining of the floor portions 23 and 25 of the top channels 22 and 24 with the ceiling portions 30 of the bottom channels 26 can be best seen in the cross-sectional illustration of FIG. 7. These intersections are thermally formed so that the material of the two sheets is, in effect, integrally connected so as to securely and fixedly connect the upper sheet of material 13 with the lower sheet of material 15 at each of those intersections.

Figure 2:
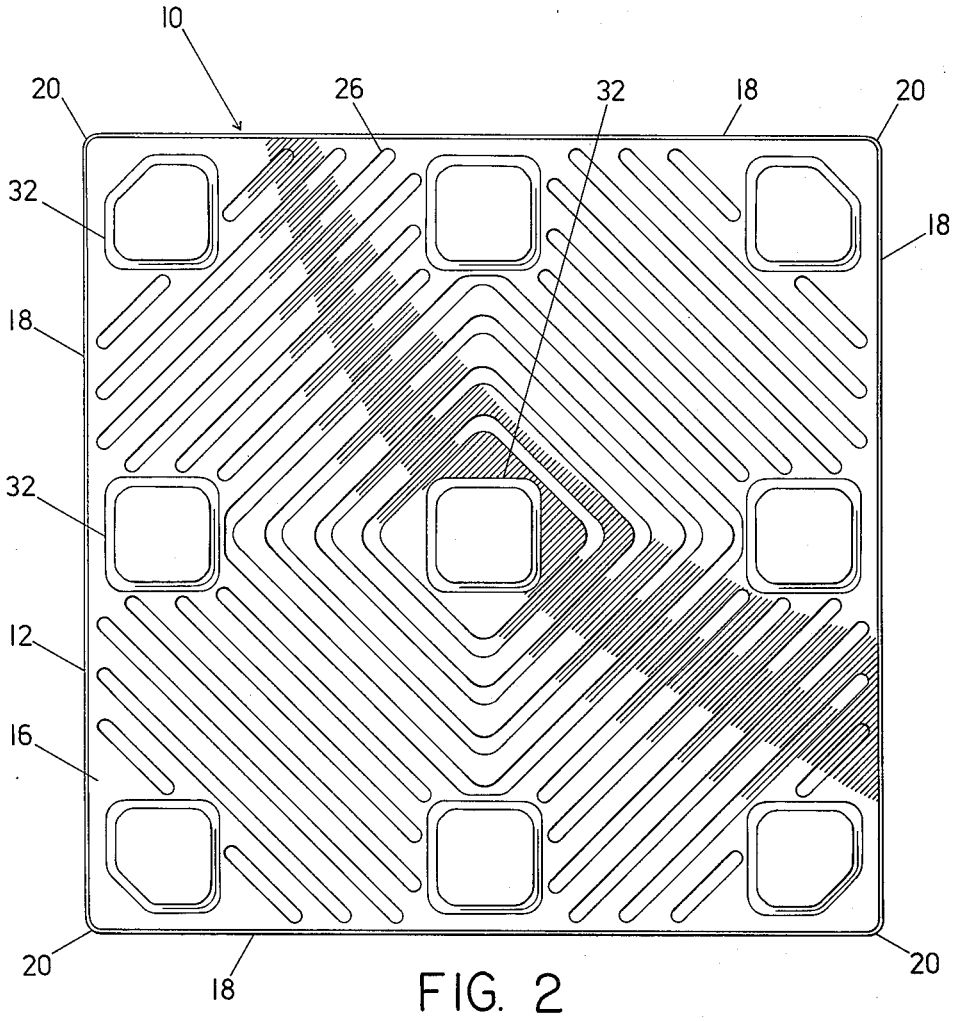
FIG. 2 is a plan view of the bottom of the pallet of FIG. 1.
Figure 3:
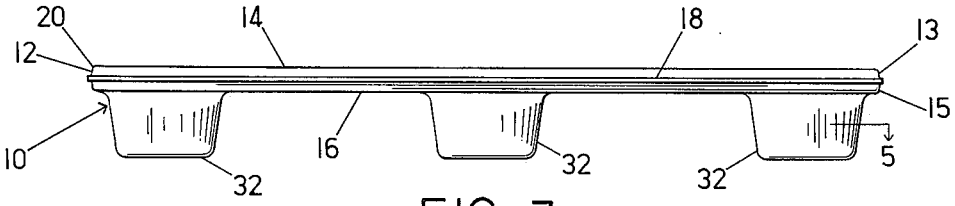
FIG. 3 is a side elevation view of the pallet of FIG. 1.
Figure 4:
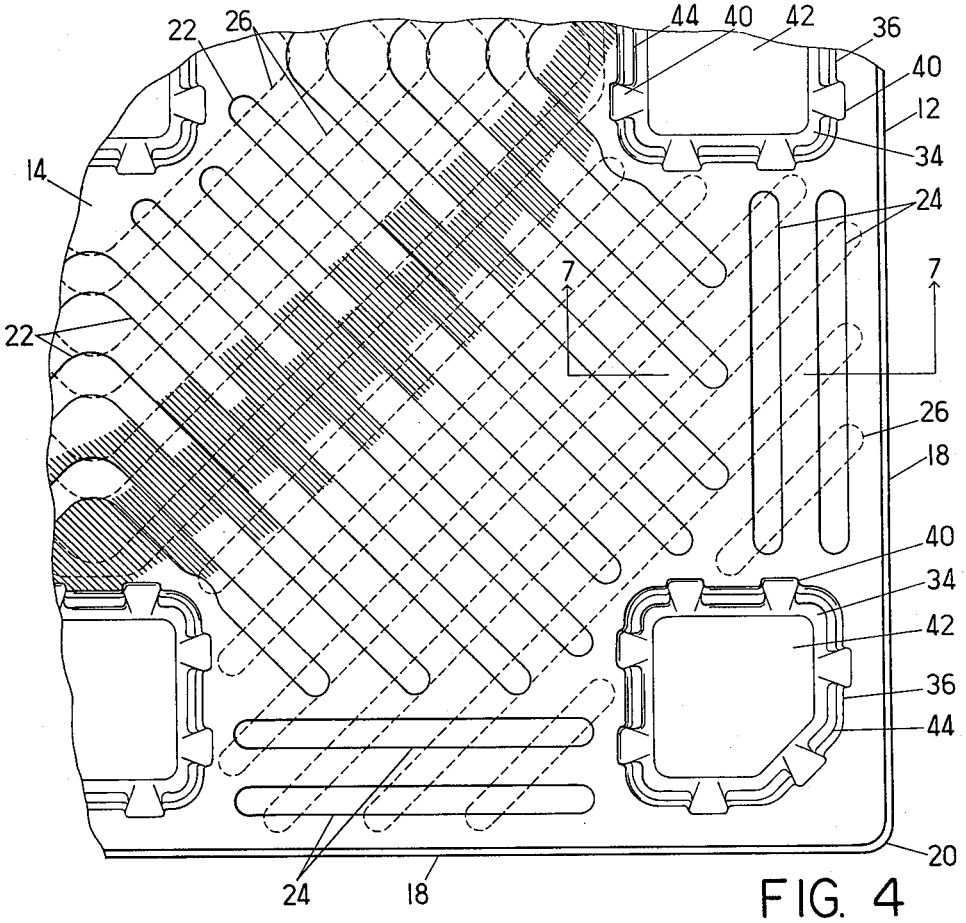
FIG. 4 is an enlarged top plan view of a section of the pallet of FIG. 1, with the bottom channels shown in phantom.
Figure 5:
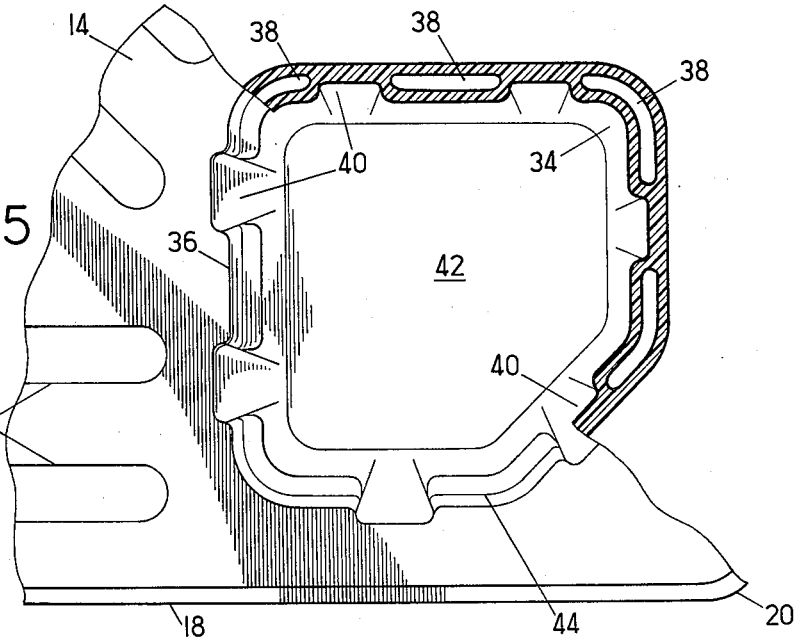
FIG. 5 is a partial cross-sectional view of an enlarged portion of the view of FIG. 4.

As can be seen by referring to any of FIGS. 1 to 3, the pallet 10 constructed in accordance with the present invention is also preferably provided with a plurality of feet 32. There are nine feet 32 in the pallet 10 of FIGS. 1–7, although the number of feet can be varied as desired. The construction of the feet 32 is shown in greatest detail in FIGS. 5 and 6. As can be seen by those figures, the feet 32 are formed as downwardly extending depressions in the load-bearing member 12. The feet 32 have a vertical height selected to raise the load-bearing member 12 off of the surface onto which the pallet 10 is placed a predetermined distance. Each of the feet 32 is generally square in shape, although each of the feet 32 located at each of the corners 20 of the pallet 10 has the outer corner thereof truncated as can be seen by looking at FIG. 5. Each of the feet 32 includes a foot floor 42 formed along the bottom of the foot 32, with the floor 42 of each foot being a planar, single-thickness section generally parallel to the load-bearing member 12. Joining the foot floor 42 to the load-bearing member 12 are a plurality of interspaced hollow portions 34 and solid portions 40. The hollow portions 34 are formed of downwardly extending portions of the upper and lower sheets of material 13 and 15, which are maintained in parallel to each other so as to define an air pocket 38 therebetween. The solid portions 40, which separate the hollow portions 38, are formed of portions of the upper and lower sheets of material 13 and 15 which are pressed together to form unitary downwardly depending portions of solid material joining the load-bearing member 12 to the foot floor 42. The interior of the foot 32 forms an upwardly open concave pocket 36. A shelf portion 44 is formed along the interior surface of each of the hollow portions 34 at a predefined and constant distance above the foot floor 42 so as to form a shelf for nesting the pallets 10 as will be described in more detail below. The side walls of each foot 32 taper generally inward as they extend downward so that the exterior dimension of the foot floor 42 is approximately equal to the horizontal dimension of the pocket 36 at the level of the shelves 44, also to aid in the nesting ability of the pallet 10.

Along the upper surface 14 of the upper sheet of material 13 and along the lower surface 16 of the lower sheet of material 15, there may be provided an anti-slip, frictional coating of material. The coating may be provided on one, or the other, or both surfaces. This coating of material has a high co-efficient of friction so as to enable material placed upon the upper surface of the pallet 10 to remain in place without slipping and to help prevent slippage of the pallet 10 on the forks of a forklift truck when the pallet 10 is picked up.

The pallet 10 of FIGS. 1 through 7 is particularly constructed so as to be readily manufacturable through a vacuum thermoforming process, more specifically, a twin-sheet thermoforming process, wherein each heated sheet is vacuum formed and the sheets are fused together as described herein by application of pressure. The pallet 10, as stated above, can be constructed of any suitable multiple thermoplastic resin material, but it has been found to be particularly desirable to manufacture the pallet 10 from high density polyethylene. In order for maximum strength, it is most desirable that the high density polyethylene have a density of at least 0.950 grams per cubic centimeter. As described above, the load bearing member 12 of the pallet 10 is contructed of upper and lower sheets of material 13 and 15. The thickness of each of the sheets of material is selected, depending upon the load requirements intended for the pallet being constructed, and preferably varies anywhere from 100 thousandths of an inch to over 250 thousandths of an inch depending on whether a light or heavy duty pallet is desired. In constructing the pallet 10, the first step of the process is to form the two sheets of material 13 and 15 through any suitable known process, such as typically an extrusion process. At the same time as the two sheets of material are created, it is highly advantageous to laminate to either one of, or both of, the upper surface 14 of the upper sheet of material 13 and the lower surface 16 of the lower sheet of material 15, a film to create a laminated non-skid upper and/or lower surface on the top and/or bottom of the pallet 10 when it is finished. It has been found that suitable materials capable of being bonded to polyethylene and providing such a non-skid surface include a variety of ethylene ethyl acetate (EEA), ethylene vinyl acetate (EVA), thermoplastic rubber (TPR), Saranex, and a modified polyolefin elastomer sold under the trademark REN-FLEX by the Ren Plastics Company. Any of these materials should be laminated to the upper sheet of material 13 and the lower sheet of material 15 after they are formed, and can be attached to the sheets through an adhesive attachment process or thermal attachment process, but are preferably co-extruded with the upper and lower sheets of material 13 and 15 so that they are inherently adhered thereto. It has been found most preferable to adhere a film of between 10 and 30 thousands, such as 15 thousandths thick film, of REN-FLEX to the upper and lower surfaces 14 and 16 of the pallet 10 to obtain a most desirable frictional surface on each side of the pallet.

In the construction of the pallet 10, the two sheets of material 13 and 15 are first each mounted onto an appropriate thermoform vacuum mold. Each of the thermoforming vacuum molds is a one-sided mold having vacuum ports provided therein intended to draw the sheet of material against the mold with the sheet of material being heated so as to generally conform to the shape of the mold. This heated thermoforming process also causes the sheet of non-skid material applied to the upper surfaces 14 and 16 of the upper and lower sheets of material 13 and 15 to further be integrally joined to the sheets of material 13 and 15. Following the formation of each of the two sheets of material 13 and 15, the two mold halves, each of which is one sided by itself, are brought together compressing the two sheets of material 13 and 15 therebetween. The two mold halves then compress the two sheets of material 13 and 15 therebetween with the material of the pallet still being hot so that the two thermoplastic sheets of material 13 and 15 are pressed together under pressure while continually in a semi-molten state. Thus, where the two sheets of material 13 and 15 are pressed together, the material of each of the sheets fuses together with the material of the other sheet forming a continuous, seamless unitary object at each such juncture. It is through this process that the entire peripheral lip 18 is formed and it is through this process that each of the floor portions 23 and 25 of the top channels 22 and 24 is joined to the ceiling portions 30 of the bottom channels 26 to form integral connections between the upper sheet of material 13 and the lower sheet of material 15. It is also at this time in the process that the feet 32 are created through appropriate deformations of the upper and lower sheets of material, with the two sheets of material being integrally connected along the foot floor 42 and along the solid portions 40 of the feet 32. It can be readily seen that since the peripheral lip 18 entirely surrounds the pallet 10 and since there are no voids provided in either the upper sheet of the material 13 or the lower sheet of the material 15 which are open to the external environment, all of the space enclosed between the upper and lower sheets of material 13 and 15 is completely closed, forming a dirt-free environment and a captive air space isolated from the external environment. After the pallet has been constructed in this fashion, the mold may be released and the pallet cooled so that it can be ready for use. The pallet after it is released from the mold is a unitary object in which the upper and lower sheets 13 and 15 are joined together in a unitary fashion at all of their intersections. The completed pallet 10 is thus one solid piece free of weak junctures or joints formed therein.

In its operation, the pallet 10 functions to provide an economical, efficient, and extremely strong pallet formed of thermoplastic material. Because of the material of which it is constructed, the pallet 10 is durable and can withstand long years of continuous use. Furthermore, because of the material from which it is constructed, the pallet 10 is recyclable when it has been damaged, deformed or worn out, so that the material therein can be recycled to construct similar new pallets. It is the advantageous structure of the pallet 10 which provides it with its extreme strength and high stability in contrast to previously known pallets constructed of such materials.

It is the structure and positioning of the channels in the load-bearing surface 12 of the pallet 10 together with the manner in which the feet 36 of the pallet 10 are constructed which allow the pallet 10 to achieve its high strength. The configuration and arrangement of the channels 22, 24 and 26 is particularly well constructed so as to both stabilize and strengthen the upper load-bearing surface 12 of the pallet 10 and also to minimize any possibility that fold lines providing lines for structural failure of the pallet 10 could be created. The structural arrangement and configuration of the channels is noteworthy in two respects. First, as can be readily seen by referring to FIG. 4, the top channels 22 provided on the interior of the upper sheet of material 13 are oriented in an direction such that they are perpendicular to the bottom channels 26 provided in the lower sheet of material 15. The fact that the channels 22 and 26 run perpendicular to each other and the fact that the floor portions 23 of the channels are 22 are joined to the ceiling portions 30 of the channels 26 at each of their junctions, means that, in essence, a grid is formed in which the upper sheet 16 is attached to the lower sheet 15 at periodic intervals and that these reinforcing channels formed on each of the upper sheet and the lower sheet are not co-extensive with each other over any length which might form a weakened, thinner portion of the load-bearing surface 12 which would be more susceptible to flexing, bending or folding. Furthermore, the fact that the channels 22 and 26 run in opposite directions minimizes any bending of the load-bearing surface 12 of the pallet since any bending loads which tend to constrict the channels formed on one side of the pallet are also expressed against the direction which the channels on the other side of the pallet are most able to resist bending or compressing stresses. Thus, the strengthening channels designed to reinforce both the upper sheet of material 13 and the lower sheet of material 15 reinforce two sheets of material along perpendicular axis so that each sheet of material, because it is inherently adhered to the other sheet of material at each of the points of intersection, helps the other sheet of material resist forces along the axis in which it would otherwise be weaker. The provision for the edge channels 24 is designed to further reinforce the edges of the load-bearing member 12 so as to particularly resist forces thereon and strengthen the edges of the pallet 10, an area which might otherwise be subject to extreme forces.

It is to be understood that while it is preferred that the top channels 22 and 24 and the bottom channels 26 be of equal depth, i.e. each equal in depth to one-half the distance between the two sheets of material 13 and 15, the depth of the top channels of the upper channels 22 and 24 added to that of the bottom channels 26 equals the distance between the two sheets of material 13 and 15.

Figure 6:
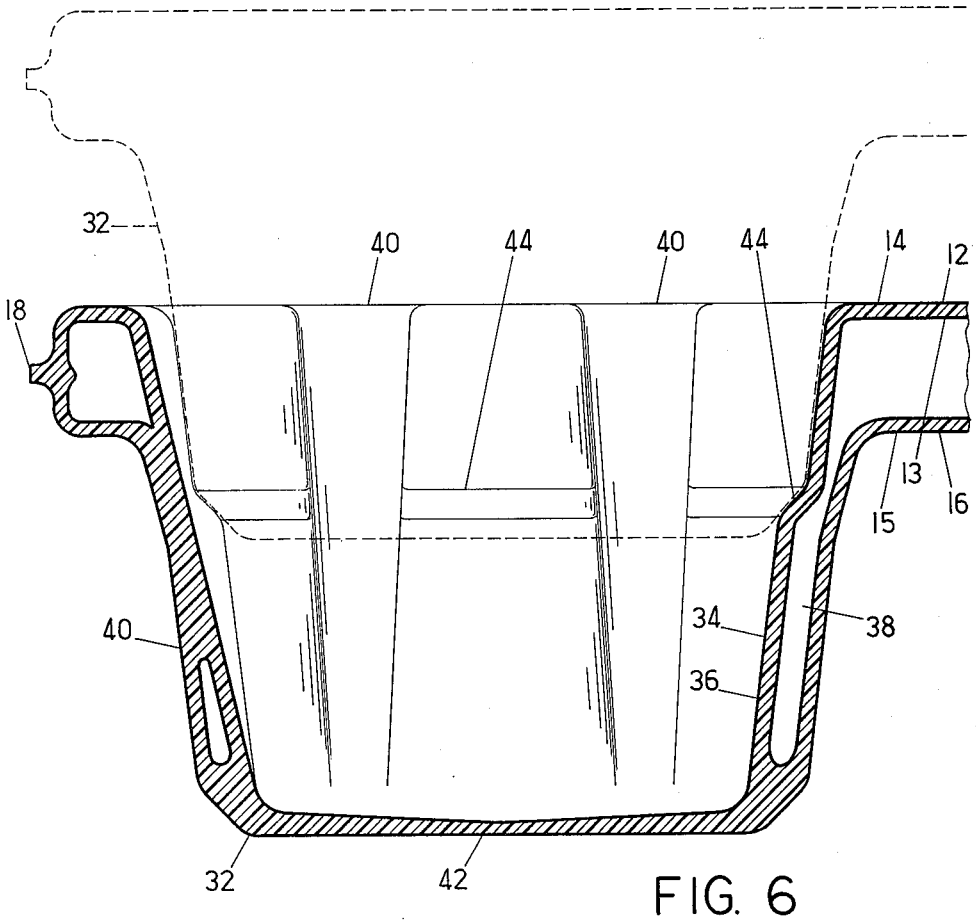
FIG. 6 is an enlarged cross-sectional view taken along the section lines 6—6 of FIG. 1.
Figure 7:
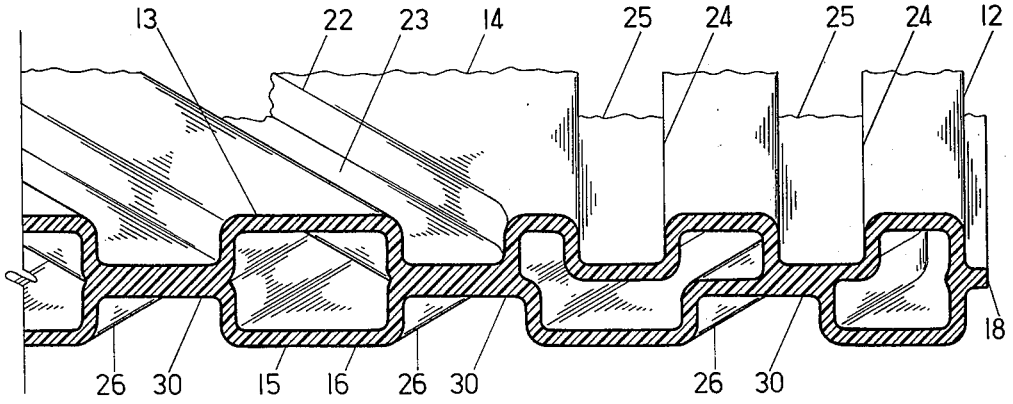
FIG. 7 is a cross-sectional view taken along the lines 7—7 of FIG. 4.

The feet 32 of the pallet 10 are also particularly constructed so as to be extremely strong and extremely resistant to deformation or collapse. As can be seen by referring to FIGS. 5 and 6, each of the feet 32 has alternating solid portions 40 and hollow wall portions 34 spaced about the periphery of the foot 32. The fact that the solid portions 40 alternate with the hollow portions 34 makes the feet 32 stronger and more crush resistant than would be possible if the entire periphery of the foot was constructed from either solid or hollow material. The solid portions 40 serve in essence as stiffening ribs for the hollow portions 34, while the hollow portions 34 break up the continuity of the solid portions 48 so that the overall strength of each of the feet 32 is stronger than would be if the entire foot was constructed of solid material and the resistance of the foot 32 to flexing under a load is greatly increased. The provision for the shelf 44 enables the feet 32 to have a nesting capability as illustrated by the dash drawing of the pallet illustrated in FIG. 6. As can be seen in that figure, the pallets 10 can be nested one upon the other with the feet 32 of the upper pallet being received within the pocket 36 of the feet 32 of the pallet therebeneath. It is for this reason that the exterior diameter of the foot floor 42 of the foot 32 is constructed so as to correspond to the size of the pocket 36 at the level of the shelf 44. While the provision for the hollow portions 34 of the feet 32 does to some extent mean that the nesting capability of the pallet 10 is somewhat limited, the provision for the shelf 44 does allow nesting of the pallet 10 as can be seen in FIG. 6 to provide a significant nesting ability capable of saving great space in the stacking and storage of the pallets 10.

It is, of course, envisioned that the pallet constructed in accordance with the present invention can be constructed from other flowable moldable materials other than the thermoplastic resins described herein. Furthermore, the materials of the pallet can be constructed in varying thicknesses and the pallet itself can be constructed of varying sizes. Nevertheless, it has been found that a heavy duty pallet constructed of two sheets of 250 thousands thickness high density polyethylene is capable of withstanding a static load of at least 60,000 pounds in a static configuration without failure. Futhermore, it has been found that each of the single feet 32 constructed in the pallet 10 in such a heavy duty pallet is capable of receiving a total load of 7,000 pounds without failure. These loads are substantially in excess of the loads which are generally utility patents such as the pallet 10 would be normally expected to receive. Accordingly, the structural features of the present pallet 10 which give rise to its structural strength and high stability make it completely adaptable for use as a general utility pallet of great strength and having a minimal chance of failure.

Figure 8:
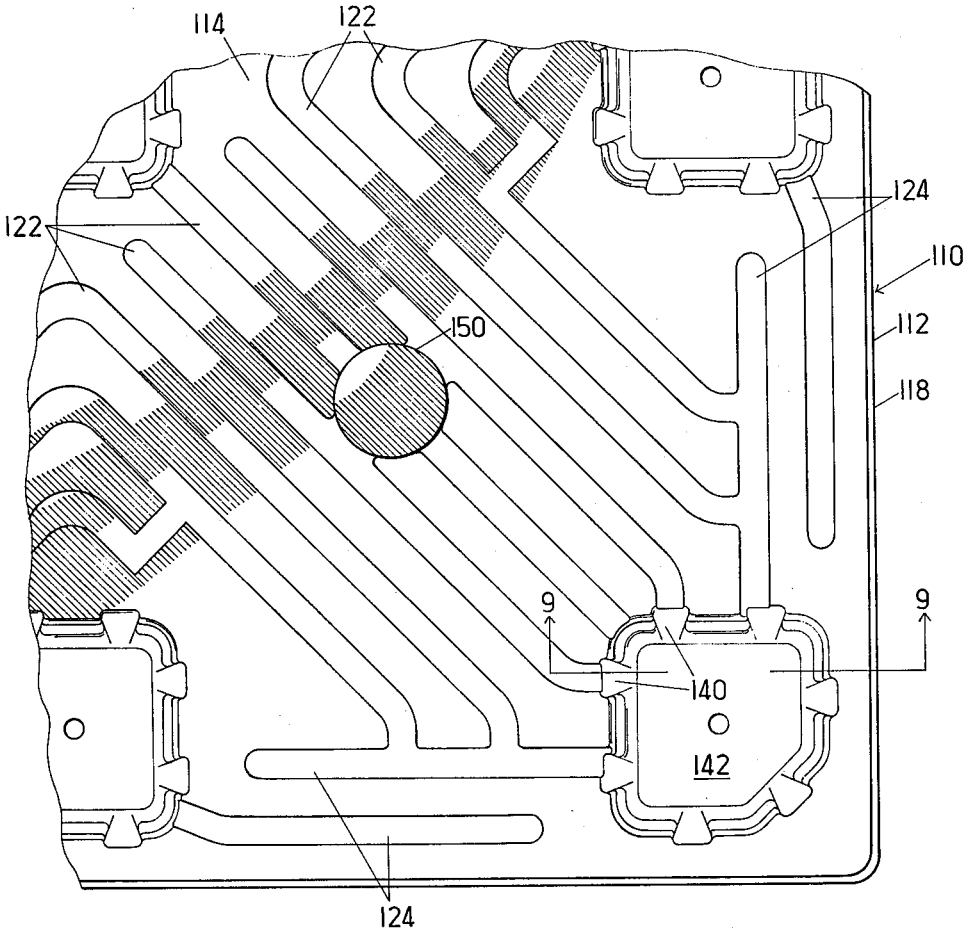
FIG. 8 is an enlarged top plan view of a portion of a pallet, similar to FIG. 4, of a pallet constructed in accordance with an alternative embodiment of the present invention.
Figure 9:
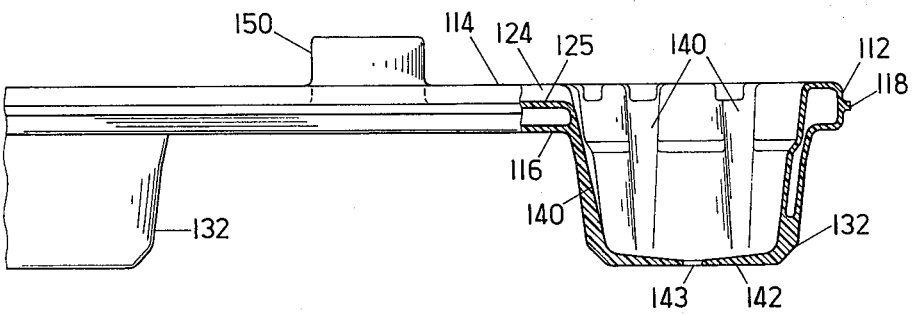
FIG. 9 is a partial cross-sectional side view taken along the line 9—9 in FIG. 8.

Shown in FIGS. 8 and 9 are a portion of a pallet 110 showing an alternative embodiment of the pallet constructed in accordance with the present invention. Parts of the pallet 110 which are similar in all respects to the pallet 10 of FIGS. 1 through 7 have been given identical reference numerals with the addition of the number 100 being added thereto. The pallet 110 is particularly adapted to be self-draining so that the pallet 10, if used for applications in which fluid containers or agricultural materials are carried on the pallet, fluids which leak from the containers or from the agricultural materials will drain from the pallet 110 and form puddles thereon. Thus, in the pallet 110, the top channels 122 and 124 are all interconnected in a continuous pattern and are also interconnected to solid wall portions 140 provided in each of the feet 132. The interconnections of the channels 122 and 124 provide a continuous draining channel pattern over the entire top surface 114 of the load-bearing surface 112 of the pallet 110. This continuous draining pattern drains into each of the feet 132, each of which is provided in the center of its foot floor a drain hole 143, as can be seen in FIG. 9. Furthermore, the mold is constructed in such a fashion that the foot floor 142 is provided with a canted bottom surface so as to drain toward the drain hole 143 provided in the center thereof so that fluid received inside of the foot 132 would drain out the drain hole 143. Thus, the provision for the interconnection of the top channels 122 and 124, together with the provision for the drain hole 143 in each of the feet 132, ensures that the entire top surface of the pallet 110 is draining with the fluid being exited from the pallet 110 through the drain hole 143.

Also shown in the pallet 110 of FIGS. 8 and 9 is a spool locator 150. The spool locator 150 is formed as an upstanding raised boss of material which is cylindrical in shape and extends above the top surface 114 of the pallet 110. The locator 150 is used for cylindrical or spooled material having an axial cavity formed therein so that the cavity of the spool or cylindrical material can be placed over the spool locator 150 to locate the spools on top of the pallet 110. It is also envisioned that other raised projections corresponding to the shapes of the materials to be loaded onto the pallet 110 can be constructed so as to particularly locate materials to be placed on the pallet 110 in a customizable fashion.

It is to be understood that the present invention is not limited to the particular arrangement and embodiments of parts disclosed and illustrated herein, but embraces all such modified forms thereof as come within the scope of the following claims.

I claim:

1. A pallet comprising:

a substantially planar load-bearing member (12) formed from an upper sheet of material (13) and a lower sheet of material (15) located generally in spaced parallel relationship to each other;

feet (32) for elevating the load-bearing member (12) a selected distance above the surface on which the pallet (10) is resting, the feet (32) depending downwardly from the load-bearing member (12), each of the feet (32) formed of walls including integral solid portions (40) formed of portions of the two sheets of material (13, 15) pressed together;

the upper sheet of material (13) having defined in its upper surface a plurality of linearly extending upwardly opening top channels (22) having a preselected depth, the top channels (22) having floor portions (23) at their bottom; and the lower sheet of material (15) having defined therein a plurality of linearly extending, downwardly opening bottom channels (26) having a depth selected so that the combined depths of the lower channels (26) and the upper channels (22) is equal to the distance between the upper and lower sheets of material (13, 15), the lower channels (26) having ceiling portions (30) formed at the tops thereof, the top channels (22) and the bottom channels (26) being so oriented relative to each other that at no point are any of the top channels (22) parallel to an adjacent one of the bottom channels (26), the floor portions (23) of the top channels (22) being integrally attached to the ceiling portions (30) of the adjacent bottom channel (26) at each location where a one of the top channels (22) intersects a one of the bottom channels (26) to firmly fix the top and bottom sheets of material (13, 15) to each other in a spaced relationship to provide strength and rigidity.

2. A pallet (10) as claimed in claim 1 wherein the pallet is made of a thermoplastic resin material.

3. A pallet (10) as claimed in claim 2 wherein the thermoplastic material is high-density polyethylene.

4. A pallet (10) as claimed in claim 1 wherein in each of the feet (32), the solid portions (40) are separated by hollow portions (34).

5. A pallet (10) as claimed in claim 1 wherein there are also border top channels (24) provided about the periphery of one of said sheets of material (13, 15) parallel to the border of the load-vbearing member (12) and also having floor portions (25) integrally joined to the ceiling portions of the adjacent channels of the other said sheet (26) to stiffen the edges of the pallet (10).

6. A pallet (10) as claimed in claim 1 wherein there is also a peripheral lip (18) provided about the exterior of the load-bearing member (12), the peripheral lip (18) being formed of a portion of the upper and lower sheets of material (13, 15) joined together.

7. A pallet (10) as claimed in claim 1 wherein the top channels (22) formed in the upper sheet of material (15) are arranged so that at all points where they are adjacent to a one of the bottom channels (26) formed in the lower sheet of material (15) they are perpendicular to the linear direction of said bottom channels (26).

8. A pallet (10) as claimed in claim 1 wherein the upper and lower sheets of material (13, 15) are made by extrusion of a selected plastic prior to the subsequent manufacture of the pallet (10) by thermoforming, and wherein a selected coating material having an effectively high coefficient of friction is co-extruded with the plastic to form a non-skid coating substantially covering and integrally co-formed with at least one of the upper surface (14) of the upper sheet of material (13) and the lower surface (16) of the lower sheet of material (15) of the load-bearing member (12) of the pallet (10) to provide a non-skid, non-adhesive coating thereon, the non-skid coating being in the form of a sheet of elastomer so adhered to the respective sheet of material (13, 15).

9. A pallet (10) comprising:

a substantially planar load-bearing member (12) formed from an upper sheet of material (13) and a lower sheet of material (15) located generally in fixed parallel relationship to each other; and a plurality of feet (32) depending from the load-bearing member (12), the feet (32) being formed as a downwardly depending portion of each of the two sheets of material (13, 15) forming an upwardly opening pocket (36) on the interior thereof, each of the feet (32) including integral solid wall portions (40) formed of deformed portions of both of the sheets of material (13, 15) fused together.

10. A pallet (10) as claimed in claim 9 wherein there are also hollow wall portions (34) separating the solid wall portions (40) in each of the feet (32).

11. A pallet (10) as claimed in claim 9 wherein the solid wall portions (40) of each of the feet (32) are formed from portions of both of the two sheets of material (13, 15) joined together and wherein each of the feet (32) terminates in a foot floor (42) which is an integral, planar horizontal sheet of solid material also formed of portions of both of the two sheets of material (13, 15) fused together.

12. A pallet (110) as claimed in claim 11 wherein there are channels (122, 124) formed in the top surface of the load-bearing member (112) all interconnected together and further interconnected to the solid portions (140) of the feet (132), and wherein there is a drain hole (143) provided in the foot floor (142) of each of the feet (132) so that fluid deposited on the top of the pallet (110) drains freely therefrom.

13. A pallet (10) as claimed in claim 9 wherein each of the hollow portions (34) of each of the feet (32) has a shelf (44) formed thereon so that a bottom of one of the feet (32) can be received inside of the hollow formed on the interior of another of the feet (32) to be received on the shelf (44) so that the pallets (10) can be nested one upon another for convenience and economy in storing and transporting the pallets (10).

14. A pallet (10) as claimed in claim 9 wherein the upper and lower sheets of material (13, 15) are made by extrusion by a selected plastic prior to the subsequent manufacture of the pallet by thermoforming, and wherein a selected coating material having an effectively high coefficient of friction is co-extruded with the plastic to form a non-skid coating substantially covering and integrally co-formed with at least one of the upper surface (14) of the upper sheet of material (13) and the lower surface (16) of the lower sheet of material (15) to provide a non-skid, non-adhesive coating thereon, the non-skid coating being in the form of a sheet of elastomer so adhered to the respective sheet of material (13), (15).

15. A pallet (110) comprising:

a substantially planar load-bearing member (112) formed from upper and lower sheets of material (113, 115) located and spaced parallel in relation to each other and having a plurality of linearly extending, upwardly opening channels (122, 124) formed in the upper sheet of material (113), the channels (122, 124) all being interconnected; and a plurality of downwardly depending feet (132) depending from the load-bearing member (112), each of the feet (132) formed of walls including integral solid portions (140) formed of portions of the two sheets of material (113, 115) fused together and having an upwardly opening pocket formed on the interior thereof and terminating in a horizontal, integral foot floor (142), the channels (122, 124) on the top surface of the load-bearing member (112) being interconnected with the interior of the feet (132) so that fluid drains from the top surface of the load-bearing member (112) into the feet (132), each foot (132) also having formed in the center of its foot floor (142) a drain hole (143) so that fluid received inside the foot (132) can drain therethrough.

16. A pallet (110) as claimed in claim 15 wherein there are linearly extending, downwardly opening channels formed in the lower sheet of material (115) in the load-bearing member.

17. A pallet (110) as claimed in claim 15 wherein the upper and lower sheets of material (113, 115) are made by extrusion of a selected plastic prior to the subsequent manufacture of the pallet (110) by thermoforming, and wherein a selected coating material having an effectively high coefficient of friction is co-extruded with the plastic to form a non-skid coating substantially covering and integrally co-formed with at least one of the upper surface (114) of the upper sheet of material (113) and the lower surface (116) of the lower sheet of material (115) to provide a non-skid, non-adhesive coating thereon, the non-skid coating being in the form of a sheet of elastomer so adhered to the respective sheet of material (113, 115).

* * * * *